US005984117A

United States Patent [19]

Smith

[11] Patent Number: 5,984,117

[45] Date of Patent: Nov. 16, 1999

[54] DISPLAY RACK WITH SHELF SUPPORTS FORMED FROM BACK WALL

[75] Inventor: Michael J. Smith, Orangeburg, N.Y.

[73] Assignee: Arrow Art Finishers, L.L.C., Bronx, N.Y.

[21] Appl. No.: 08/918,031

[22] Filed: Aug. 25, 1997

[51] Int. Cl.[6] ..... B42F 7/00

[52] U.S. Cl. ..... 211/55; 211/128.1; 211/126.2

[58] Field of Search ..... 211/55, 128.1, 211/130.1, 126.16, 132.1, 126.2, 135

[56] References Cited

U.S. PATENT DOCUMENTS

| | | | |
|---|---|---|---|
| 1,930,978 | 10/1933 | King | 211/85.17 |
| 1,938,898 | 12/1933 | Freymann | 211/128.1 |
| 2,251,814 | 8/1941 | Yohns | 211/130.1 |
| 2,651,421 | 9/1953 | King | 211/55 |
| 2,937,764 | 5/1960 | Ingold | 211/130.1 |
| 3,696,940 | 10/1972 | Hofman et al. | 211/126.16 |
| 4,460,097 | 7/1984 | Darnell et al. | 211/189 |
| 4,905,845 | 3/1990 | Broeker et al. | 211/55 |
| 5,040,688 | 8/1991 | Martin et al. | 211/55 |
| 5,595,308 | 1/1997 | King et al. | 211/40 |
| 5,702,011 | 12/1997 | Carroll | 211/135 |
| 5,720,396 | 2/1998 | Wegscheid et al. | 211/55 |

*Primary Examiner*—Daniel P. Stodola
*Assistant Examiner*—Gregory J. Strimbu
*Attorney, Agent, or Firm*—Kirschstein, et al.

[57] ABSTRACT

A display rack has flat-bottomed compartments for holding stacks of generally planar, sheet material items in a manner which prevents lower ends of the items from being squeezed when the items are inserted or removed from the compartments. The rack has a back wall, two side walls, a top wall and a bottom wall that bound an upright space. A plurality of supports are secured to the back wall and support a plurality of partitioning walls, one above another, along a vertical direction in mutual parallelism along an angle of inclination. Each support has a first mounting element having an upper base surface that directly engages and supports all the lower ends of the items, and a second mounting element connected to a respective partitioning wall.

8 Claims, 2 Drawing Sheets

DISPLAY RACK WITH SHELF SUPPORTS FORMED FROM BACK WALL

BACKGROUND OF THE INVENTION

1. Field of the Invention

The present invention relates in general to arrangements for holding various items on display in retail establishments or the like, and more particularly to display racks designed for holding essentially flat items, such as greeting cards, brochures or the like.

2. Description of the Related Art

There are already known various constructions of display arrangements, among them such that are especially suited for holding essentially flat (e.g., relatively thin sheet-shaped) items or objects in respective pockets staggered relative to one another in the vertical direction. In many instances, each of such pockets is dimensioned for receiving a limited, yet still quite substantial, number of such items (greeting cards with envelopes, pamphlets, or whatever such items may be), usually all of the same kind, so as to offer the prospective purchaser or taker of such items a variety of such items in a close proximity to one another, without having to replenish such items every time one of them is taken away.

In stationery or department stores, such display arrangements are ordinarily constituted by rather sturdy permanent structures made of wood, particle board, rigid plastic materials or the like. However, there are applications where the expense involved in purchasing, erecting and/or maintaining such permanent structures is not justified either because the demand for such items is relatively low (but not low enough to dispense with this kind of items altogether), or because the size and/or location of such a display is to be changed frequently or occasionally (in which case the dismounting and re-erecting of such permanent structures would put an unreasonable burden on the person in charge of rearranging the display), or simply because the money for such permanent structures is not available at the moment, or for other reasons.

For these circumstances, there have already been developed in the past semi-permanent display structures made of corrugated board or similar relatively inexpensive materials, but yet sufficiently sturdy to withstand the rigors they are exposed to at the respective establishment using them, if not forever then for a sufficiently long time to make them economically attractive despite such lack of permanency. Not only are such display structures relatively inexpensive (an important but often not decisive factor), but they are also relatively easy to move from one location to another (with or without the items) and, if need be, easily disassembled for storage or transportation while occupying only a minimum space, and just as easily re-erected, on an as-needed basis.

One problem encountered with these semi-permanent structures in the past was, however, their potential for mangling the items accommodated in the respective pockets. In this respect, it is to be realized (besides taking into account the fact that human intervention is ordinarily required before any such item is actually damaged) that the generally V-shaped cross-sectional configuration of the respective space or pocket receiving such items (or item groups or supplies) is the primary cause of such a danger. More particularly, as the pocket converges in the downward direction (until it reaches a "bottom line"), some of the items will slide deeper into the pocket than others while the group of them is inserted, but all of them will be squeezed at their lower ends in the process.

Now, when subsequently one of such items is removed from the respective pocket, the considerably compressed lower regions of the effected adjacent items will quite vigorously rub against one another. The situation is even worse when the person who had removed such an item subsequently tries to return it into the pocket and pushes it down to get it "into its right place", since by that time the other items have already readjusted themselves to the absence of such an item, and the "right place" is gone and must be recreated by forcing such other items out of the way. While one such removal and return may not do much damage, if any, multiple ones may; besides, the need for the individual taker of an item to use large force, in relative terms, for removing and returning the item he or she is interested in is an inconvenience at the very least, and a decisive factor in causing the interested person to eschew taking the item at worst.

OBJECTS OF THE INVENTION

Accordingly, it is a general object of the present invention to avoid the disadvantages of the prior art.

More particularly, it is an object of the present invention to provide a display rack for essentially flat items that does not possess the drawbacks of the known display racks of this type.

Still another object of the present invention is to devise a display rack of the type here under consideration which is capable of holding the items on display in a non-interfering manner despite its relative simplicity.

It is yet another object of the present invention to design the above display rack in such a manner as to make it easy for a person interested in exploring any particular item on display on the rack to take such an item off of the rack and return it there after examination if so disposed.

A concomitant object of the present invention is so to construct the display rack of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display rack for holding a multitude of essentially flat items in a vertically staggered relationship. The display rack of the present invention includes as one of its components an essentially box-shaped main body including at least a back wall and two side walls connected to one another and together bounding a recess that is open to the front as considered in a use position of the display rack.

The rack further includes a plurality of partitioning walls arranged in the recess in a vertically staggered relationship and each secured at least to the back wall and extending therefrom in its final position at an acute angle as considered in the upward direction in the use position of the display rack, thus forming with the back wall a respective space in the recess that converges downwardly in a cross-sectionally V-shaped manner, with vertically adjacent ones of the partitioning walls together bounding respective pockets for receiving the items.

According to the present invention, there is further provided supporting means for supporting the respective items received in the respective ones of the pockets from below at a distance from the bottoms of the respective V-shaped spaces, each of such supporting means being secured to the back wall and to the respective one of the partitioning walls and extending across the respective one of the V-shaped spaces to form an abutment for such items preventing them from descending any deeper into the respective V-shaped spaces. An important advantage of the display rack construction as described so far is that the supporting means holds the items at respective elevations at which the narrowest region of the respective pocket is still wide enough for the lower regions of the items not to be unduly pressed against the back or partitioning walls or, if a number of such items is accommodated in each of such pockets, as is typically the case, against each other.

A particularly advantageous construction of the display rack is obtained when each of the support means includes an essentially sheet-shaped mounting element forming a bottom wall of the respective pocket in the respective V-shaped space that presents a flat upper surface for the respective items to rest on. In this manner, there is obtained a large-area bottom support for the items, thus further reducing the danger of damage as compared to a situation where the support from below would be localized.

A particularly simple and otherwise advantageous construction is obtained when each of the mounting elements is constituted by a portion of the back wall displaced out of the plane of the latter and secured to the respective one of the partitioning walls. Especially in this regard, it is advantageous for each of the mounting elements to include one section connected with the back wall, and another section secured to the respective one of the partitioning walls.

In accordance with another advantageous aspect of the present invention, each of the partitioning walls includes two sections that partially overlap one another, and the aforementioned other section of the respective one of the mounting elements is confined between the two partitioning wall sections, in the final position of the partitioning wall. Then, it is further advantageous when there is provided means for securing the partitioning wall sections to one another at least at one location distant from an upper edge region of the respective partitioning wall at which its sections are joined to one another. Such securing means advantageously includes an adhesive layer situated at least at the distant location, but advantageously extending substantially all the way from the distant location to the upper edge region of the respective one of the partitioning walls. It is currently preferred to situate the aforementioned distant location between the other mounting element section and the partitioning wall upper edge region, thus securely but removably clamping the other mounting section between the two partitioning wall sections.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
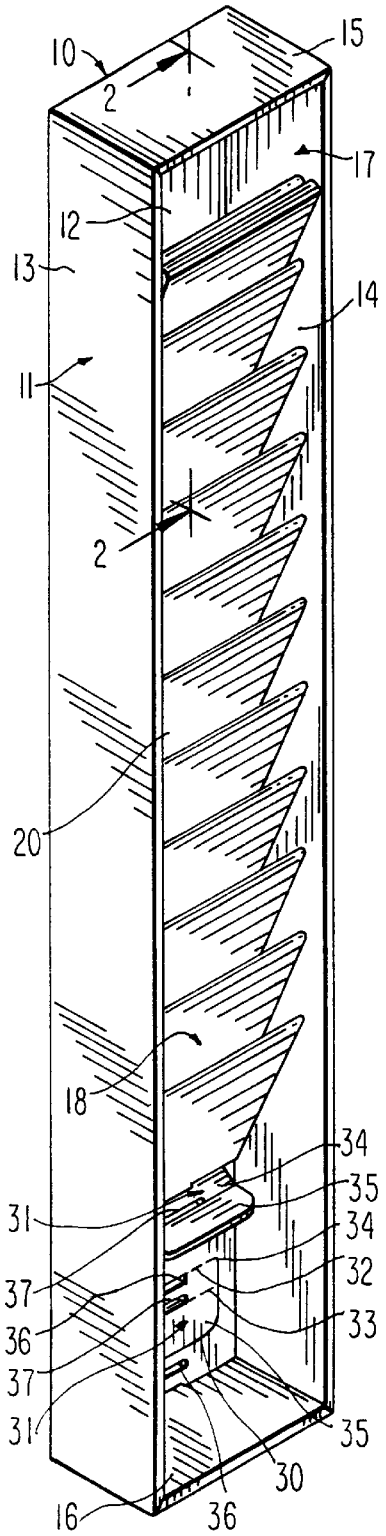
FIG. 1 is a perspective view of a display rack of the present invention.

Referring now to the drawing in detail, and first to FIG. 1 thereof, it may be seen that the reference numeral 10 has been used therein to identify a display rack of the present invention in its entirety. While the display rack 10 was developed for use in stationery, variety or department stores or other retail establishments for displaying greeting cards or the like, its use is obviously not so limited; rather, it may also find a useful application in other situations, for instance in tourist, sales or other offices for displaying advertising brochures or pamphlets or the like. As a matter of fact, the only actual limits on the use of the display rack 10 are the boundaries of human imagination, practical needs, and, as will become obvious later, the requirement that the items to be displayed on the display rack 10 be essentially flat.

The display rack 10 includes as one of its components a main body 11. As shown, the main body 11 consists of a back wall 12, two side walls 13 and 14, a top wall 15, and a bottom wall 16, all of them being joined at respective corners to their respective neighbors to form a generally box-shaped structure and to jointly bound or define a recess 17. The main body 10 is made of a relatively inexpensive sheet material, such as cardboard, especially that of the corrugated variety, that is somewhat flexible but nevertheless possesses sufficient rigidity for the display rack 10 to be not only self-supporting but to be also able to support other components and/or items.

Such other components include, as also shown in FIG. 1, a multitude of compartmentalizing, partitioning, or separating walls 20 mounted in a staggered relationship one above the other on the main body 11 and subdividing the recess 17 into a comparable multitude of individual compartments 18. In order not to unduly clutter the drawing and to judiciously use the available resources, only one of such partitioning walls 20 and one of such compartments 18 are specifically identified by its respective reference numerals in FIG. 1. It is to be mentioned at this juncture that the display rack 10 as illustrated in FIG. 1 is not yet in its final assembled condition; rather, two bottom ones of the partitioning walls 20 have not yet been installed, in order to afford a relatively unimpeded view of the bottom region of the back wall 12 of the main body 11 and certain features of that wall 12.

The reason for providing such features will be explained later, especially in conjunction with FIGS. 2 and 3 of the drawing; however, at this point it will be best to briefly divert attention to FIG. 4 of the drawing that depicts one of the partitioning walls 20 and reveals certain additional features that find their utility in cooperating with the aforementioned features of the back wall 12 of the main body 11. First of all, it is to be mentioned that the particular illustrated partitioning wall 20, like any other one of such partitioning walls 20, consists of two portions 21 and 22 that are shown to be juxtaposed with one another in a manner reminiscent of, but not identical with, that which they assume in actual use.

As shown, the two portions 21 and 22 are constituted by sections of a single piece of sheet material, which may be similar or even identical in appearance, thickness etc. to that of the main body 11, that are joined to one another at a hinge or fold region 23 and are folded over each other. The use of such unitary construction of the partitioning wall 20 has its advantages over making the portions 21 and 22 separate from each other, especially the ease of handling and the avoidance of the otherwise existing need for matching the right sections 21 and 22 with each other during assembly, both in terms of type and orientation. However, it will become apparent later that this unitary construction is not essential to the present invention.

Figure 4:
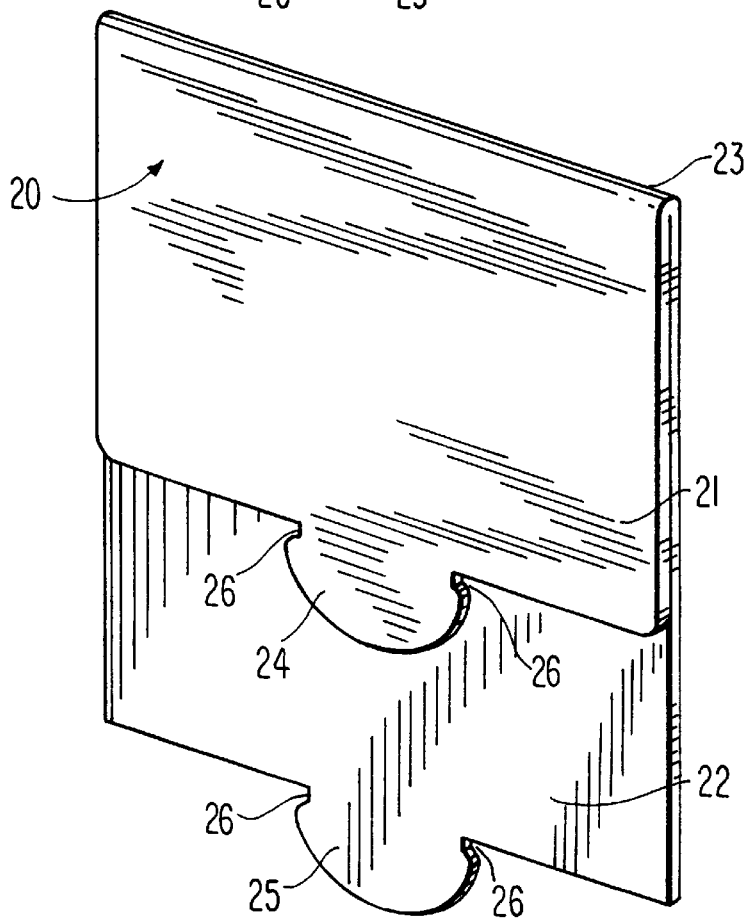
FIG. 4 is a perspective view of a partitioning wall used in the display stand of FIG. 1, shown in its folded condition and on a scale commensurate with those of FIGS. 2 and 3.

As also illustrated in FIG. 4, the portions or sections 21 and 22 of the partitioning walls are generally rectangular in configuration, with the portion 21 being somewhat smaller in "height" (i.e., the vertical dimension as considered in FIG. 4)—but not necessarily in width—than the portion 22. Because of the positions the partitioning wall portions 21 and 22 assume in actual use, they will occasionally be referred to herein as the "top" and "bottom" ones, respectively. Each of the top and bottom wall portions 21 and 22 is equipped with its own tab, extension or protuberance 24 and 25, respectively. As shown, the protuberances 24 and 25 are what may be referred to as generally mushroom-shaped, that is their contours are arcuate, turning back on themselves to form respective detent notches 26, the function of which will be clarified later.

As indicated in FIG. 1, the back wall 12 of the main body 11, rather than being solid throughout, is provided, for each of the partitioning walls 20, with a through cut 30 that separates a generally rectangular (with rounded corners, though) mounting region 31 on three of its four sides from the remainder of the back wall 12, while the fourth side is pre-formed with or eventually constituted by a hinge zone indicated at 32. Another hinge zone 33, substantially parallel to the hinge zone 32, is either pre-formed or eventually formed in the mounting region 31, thus optimally but, as will be realized later, more importantly, functionally subdividing the latter into two mounting sections 34 and 35. The integrity of the back wall 12 (or, as shown, that of the mounting region 31) is further intentionally violated by respective through slots 36 and 37 shown to be situated at the hinge zones 32 and 33, respectively. Only those of the multitude of cuts 30, mounting regions 31, hinge zones 32 and 33, mounting sections 34 and 35, and slots 36 and 37 associated with the lowermost two (not yet mounted) partitioning walls 20 are specifically shown in FIG. 1, though.

Figure 2:
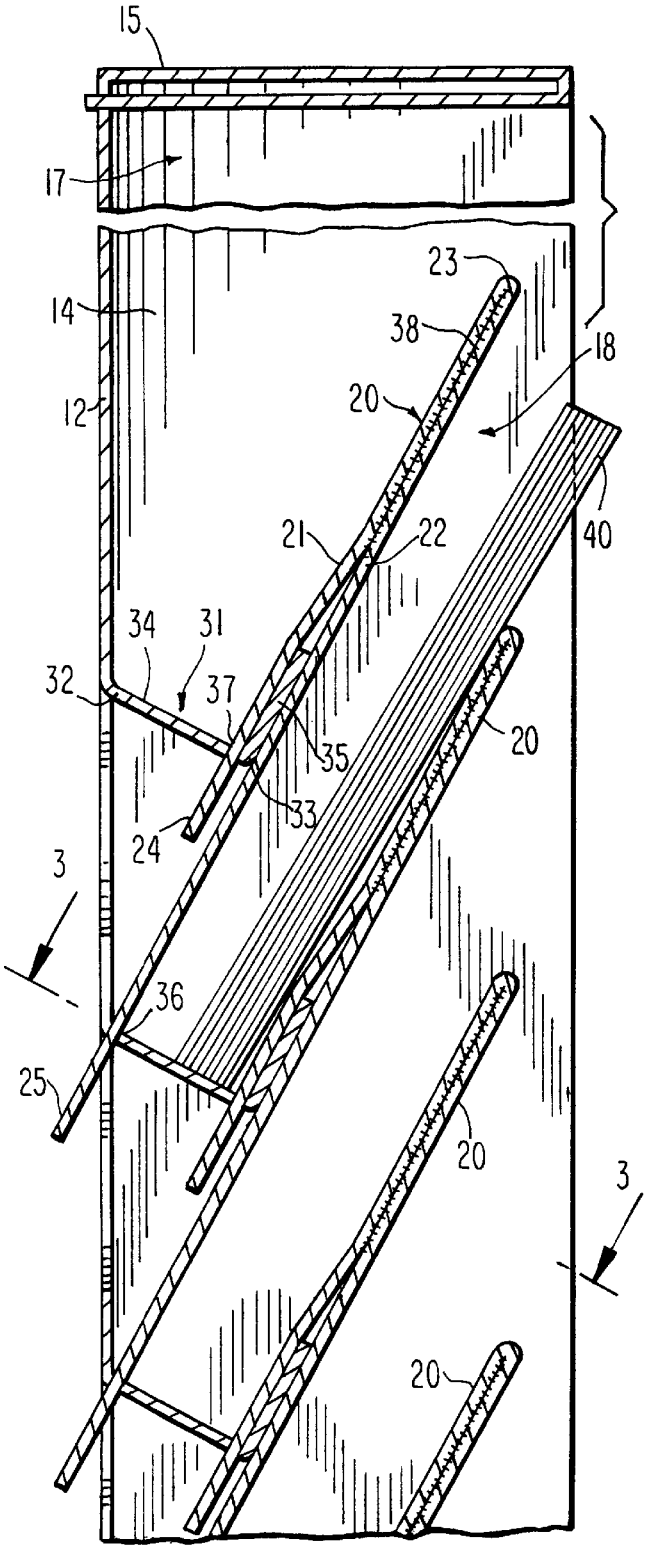
FIG. 2 is a sectional view taken on line 2—2, and showing merely a fragment of the display rack on a scale exceeding that, of FIG. 1.

The situation is different in FIG. 2; there at least the top two top ones of the partitioning walls 20 that are fully shown (but, by logical extension, the partially depicted ones as well) are fully mounted and supported on the back wall 12 by means of the aforementioned features of the latter and of the former constituted by the mounting regions 31 of the back wall 12 with their associated formations and the protuberances 24 and 25 of the partitioning walls 20, respectively. It is clearly indicated there on the example of the topmost partitioning wall 20 by the profound use of reference numerals that have not been as meticulously applied elsewhere that the section 35 of the mounting region 31 is sandwiched between the sections 21 and 22 of the partitioning wall 20, whereas the section 34 extends between the back wall 12 and the partitioning wall 20 under consideration here.

For reasons that ought to be obvious (primarily to prevent the sections 24 and 25 from "opening up" and hence releasing the section 35 from their embrace), the sections 21 and 22 of the partitioning wall 20 are secured to one another, as indicated by a stippling at 38 that is indicative of the presence thereat of an adhesive substance, at an area extending at or to a certain distance away from the top edge of the partitioning wall 20 even when the latter is constituted, as shown, by the hinge region 23, thus providing for a true confinement of the section 35 between the sections 21 and 22. Such confinement, coupled with the action of gravitational forces (possibly with some help from the person setting the display rack 10 up), causes the partitioning walls 20 and the section 34 to assume their position shown with particularity in FIG. 2 of the drawing. Depending on the chosen dimensioning and positioning of the cut 30, the crease or hinge zone 33 within the mounting portion 31, and the partitioning sections 21 and 22 with respect to one another, it is possible to choose the inclinations of the partitioning walls 20 and of the mounting section 34 relative to the horizontal and to one another, either to coincide with the illustrated substantially 45°/135° arrangement in which the partitioning wall 20 and the mounting section 34 are substantially perpendicular to each other, or to deviate from this arrangement within certain limits even to the extent of defeating the aforementioned orthogonality.

It should go without saying that the confinement of the respective mounting section 35 between its associated partitioning wall sections 21 and 22 is not the only means holding the respective partitioning wall 20 on the back wall 12. Nevertheless, there is no harm in mentioning that the mushroom-shaped protuberances 24 and 25 of the partitioning wall sections 21 and 22 in question are inserted into and retained in the slots 37 and 36 of the associated mounting portion 31, and of the one situated below it, respectively. Theoretically, this retaining action should be sufficient for preventing the partitioning sections 21 and 22 from loosening their grip on the mounting section 35 to the detriment of the mounting action; yet, experience has shown that the provision of the indicated adhesive layer 38 or similar connecting means (but preferably not staples that could damage the items to be accommodated in the compartments or pockets 18 as indicated at 40) is advisable at least under some circumstances. Of course, the generally mushroom-head shapes of the protuberances 24 and 25 are instrumental in assuring or facilitating the retention of the protuberances 24 and 25 in their respective slots 37 and 36, as a result of the material of the back wall 12 or mounting portion 31 surrounding the respective slot 37 or 36 entering the associated detent notches 26 at least at one end of the slot 37 or 36. This action is further enhanced by making the (somewhat elastically deformable) protuberances 24 and 25 slightly wider than the corresponding dimensions of the associated slots 37 and 36

Figure 3:
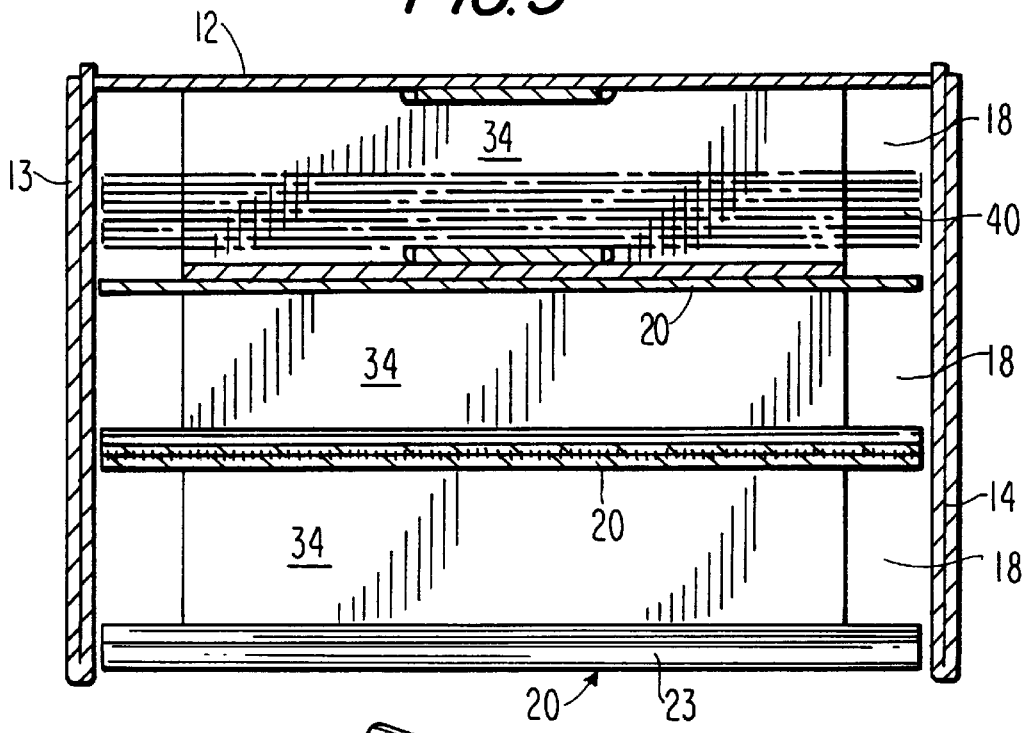
FIG. 3 is cross-sectional view through the display rack, taken on line 3—3 of FIG. 2.

As may be observed especially from viewing FIGS. 2 and 3 in conjunction with one another, the provision in accordance with the present invention of the mounting portion 31 and particularly of the mounting section 34 provides the compartments 18 with substantially flat bottom surfaces for the lower edges of the items 40 to rest on. This, of course, means not only that the items 40 can be easily individually or jointly introduced into or removed from the respective compartments or pockets 18, but also, and more importantly, that such items 40 will not be introduced into (or removed from) a downwardly narrowing or tapering space, with potential damage to some or all of the items 40 due to rubbing against each other, against the surfaces bounding the pockets 18, being forced or scrunched into insufficient space, or the like. It will be understood that each of the elements described above, or two or more together, may also find a useful application in other types of constructions differing from the type described above. So, for instance, if the weakening of the back wall 12 by the cuts 30 and the openings left behind after the mounting portions 31 are bent out of the plane of the back wall 12 were unacceptable or undesirable, it would be possible to make the respective sections 34 and 35 of each mounting portion 31 as parts of an element separate from the back wall 12. This separate element, if only one such element were provided common to all of the mounting portions 31, or each individual such element if one element were provided with respect to one or more but not all of the mounting portions, would then be secured (for reasons akin to those mentioned before preferably by an unobtrusive technique, such as glueing) to the back wall 12 and/or the side walls 13 and 14.

While the present invention has been described and illustrated herein as embodied in a specific construction of a display rack for greeting cards, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A display rack for holding a plurality of stacks of generally planar, sheet material items having lower edges, comprising:

a) an upright back wall extending along a vertical direction;

b) a pair of upright side walls extending along the vertical direction and connected to opposite sides of said back wall to define a space with said back wall;

c) a plurality of supports secured to said back wall, said supports having slots extending through said supports, each of said supports including a generally planar, first mounting element extending from said back wall into said space and having a generally flat upper base surface, and a generally planar, second mounting element extending from said first mounting element into said space; and d) a plurality of partitioning walls respectively mounted on said supports in mutual parallelism, one above another along the vertical direction, in said space, each of said partitioning walls being supported by said second mounting element of a respective one of the supports, and defining, with said first mounting element of the respective one of the supports, a pocket for receiving a respective one of the stacks of the sheet material items with the lower edges of the sheet material items in the respective one of the stacks directly engaging and being supported by said upper base surface of the first mounting element of the respective one of the supports, each of said partitioning walls including two sections that partially overlap one another, said two sections of each of said partitioning walls having individual protrusions that are received in the slots of the respective one of said supports.

2. The display rack as defined in claim 1; and further comprising a top wall and a bottom wall.

3. The display rack as defined in claim 1, wherein said first mounting element of each of said supports lies in a first set of planes, wherein said second mounting element of each of said supports lies in a second set of planes, and wherein said first set of planes is generally orthogonal to the second set of planes.

4. The display rack as defined in claim 3, wherein each of the partitioning walls generally lies in said second set of planes.

5. The display rack as defined in claim 1, wherein said supports are integral with, and hinged to, said back wall.

6. The display rack as defined in claim 1, wherein said walls and said supports are each comprised of a corrugated board material.

7. The display rack as defined in claim 1, wherein each of the partitioning walls extends between the side walls.

8. The display rack as defined in claim 1, wherein said second mounting element of the respective one of the supports is confined between the overlapping sections of a respective one of said partitioning walls.

* * * * *